United States Patent [19]

Bird

[11] Patent Number: 4,796,556

[45] Date of Patent: Jan. 10, 1989

[54] ADJUSTABLE COATING AND PRINTING APPARATUS

[75] Inventor: John W. Bird, Westport, Conn.

[73] Assignee: Birow, Inc., Westport, Conn.

[21] Appl. No.: 65,954

[22] Filed: Jun. 24, 1987

[51] Int. Cl.[4] ..... B05C 11/00

[52] U.S. Cl. ..... 118/46; 118/262; 101/177

[58] Field of Search ..... 118/46, 262, 249; 101/177

[56] References Cited

U.S. PATENT DOCUMENTS

| | | | |
|---|---|---|---|
| 4,270,483 | 6/1981 | Butler et al. | 118/46 |
| 4,308,796 | 1/1982 | Satterwhite | 118/46 X |
| 4,397,237 | 8/1983 | Makosch | 118/262 X |
| 4,421,027 | 12/1983 | Fischer | 101/177 X |
| 4,569,306 | 2/1986 | Ito et al. | 118/46 X |
| 4,615,293 | 11/1986 | Jahn | 118/46 |
| 4,685,414 | 8/1987 | DiRico | 118/46 |

OTHER PUBLICATIONS

Gregory J. Lindner; "Nonflammable Aqueous Overcoatings Serve to Speed Ink Drying, Add Gloss to Printed Sheet"; Graphic Arts Monthly, Oct. 1977, pp. 66–69.

*Primary Examiner*—Shrive Beck

*Assistant Examiner*—Alain Bashore

*Attorney, Agent, or Firm*—Peaman & Green

[57] ABSTRACT

An offset lithographic printing machine having a plurality of in-line liquid application stations, at least one of which is an ink image printing station for printing lithographic ink images onto suitable receptive copy sheets, and the final downstream liquid-application station being a coating application station for printing a protective, and/or aesthetic coating over selected portions of, or over the entire ink image-printed surface of the copy sheets. The coating application station comprises a plate cylinder adapted to print liquid coating composition onto predetermined selected areas of the ink image-printed copy sheets by offset-transfer to an intermediate blanket cylinder, a said blanket cylinder adapted to receive said liquid coating composition from the plate cylinder for retransfer onto predetermined selected image-printed areas of the image-printed copy sheets, and also adapted to receive a continuous liquid coating composition for retransfer as a continuous overall coating over the image printed areas of the image printed copy sheets. An adjustable coating-application carriage is supported for movement into coating association with either the plate cylinder blanket cylinder desired, for the application of a printed coating over either preselected limited areas or over the entire image-printed surface of the copy sheets.

23 Claims, 4 Drawing Sheets

ADJUSTABLE COATING AND PRINTING APPARATUS

BACKGROUND OF THE INVENTION

Conventional lithographic offset printing machines or presses comprise one or more image printing stations each having a printing roll (sometimes referred to as a plate cylinder) to which is fastened a thin hydrophilic, oleophobic printing plate having image areas which are oleophilic and hyrdoprobic and background areas which are oleophobic and hydrophilic. The plate surface is continuously wetted with aqueous' damping solution which adheres only to the background areas, and inked with oleoresinous ink which adheres only to the image areas of the plate as wet ink. The ink is offset transferred to the rubber surface of a contacting blanket roll (sometimes referred to as a blanket cylinder), and then retransferred to the receptive surface of a copy web or a succession of copy sheets, such as of paper, where the ink air-dries by oxidation and curing after passing through a drying station.

Since image-drying is gradual, it is conventional to spray the printed copies with starch or other "stilting" powder before the copies are stacked. This prevents sticking of the ink images to adjacent copies and also permits the circulation of air for the oxidation curing process.

In cases where cost is not a factor and/or where the aesthetic advantages of a protective supercoating are desired, it is known to provide the printing machine with a downstream coating station having a blanket roll associated with a coating application unit for the application of an overall protective coating over the entire printed area of the copy sheets or web. This also avoids the necessity of powdering the printed images. Reference is made to U.S. Pat. No. 4,270,483 for its disclosure of such an apparatus. The coating unit of U.S. Pat. No. 4,270,483 is pivotally-associated with the blanket roll for movement between coating and noncoating or retracted positions.

It is known to apply pattern coatings of protective composition by means of blanket rolls by cutting into the rubber surface of the blanket to leave raised or relief surface islands which selectively receive the coating composition from the application roll for retransfer to selected areas of the copy sheets in the form of pattern coatings. This procedure has several disadvantages. The make-ready time required for the preparation of such relief blanket rolls is excessive and the procedure requires the tedious, precision efforts of an expert in order to approximate the required registration, whereas precise relief printing plates used on a printing roll can be produced photographically in a short period of time with a minimum of effort and expertise. Moreover, the attachment of a relief printing plate to a plate cylinder provides some degree of adjustability, axially as well as circumferentially, to provide better registration if necessary, whereas no adjustment of the relief portions is possible relative to the blanket roll or cylinder.

Protective coating compositions also improve the appearance of printed documents, particularly high quality, multi-color copies such as posters, record jackets, product brochures, etc., by providing glossy or matte finishes over the entire image-printed surface or over selected image-printed portions thereof such as photographs, product illustrations, etc. Selected area coating, spot coating or perfect registration over predetermined limited printed areas of the copies is advantageous from a cost standpoint since the coating compositions are relatively expensive and the volume required is reduced if the coating is only printed in registration where desired. Also, spot coating is frequently used as a means for highlighting certain portions of the printed copies such as company name or logo, product illustrations, photographs, etc.

While the cost of the protective coating compositions is an important factor, a more important cost factor is the necessity of removing the printed copies from an offset printing press and then running them a second time through a coating machine to print either a full protective coating or a spot protective coating, as desired. This problem is overcome by U.S. Pat. No. 4,270,483 with respect to the in-line printing of overall or continuous protective coatings but the problem of providing in-line spot printing of protective coatings with a minimum of make-ready time and a high degree of precision thickness remains.

SUMMARY OF THE INVENTION

An essential objective of the present invention is to provide a printing machine or press for the printing of imaged subject matter onto a receptive substrate, such as a copy web or a succession of copy sheets, said printing machine having a downstream coating station designed for the application of either continuous or spot coatings, as desired, over the image-printed copies in a continuous in-line process.

Another object of the present invention is to provide a coating apparatus designed to be mounted at the final downstream ink-application station of a conventional offset printing machine or press having a plurality of ink-application stations to convert said machine or press, intermittently if desired, to the in-line application of either continuous or spot coatings, as desired.

Yet another object of this invention is the provision of a single coating application apparatus mounted in association with the final downstream liquid application station of a printing press having a plurality of liquid application stations, each having a plate cylinder, a blanket cylinder and an impression cylinder, the coating application apparatus comprising a coating carriage which is adjustable between one coating position in which it coats the plate cylinder and another coating position in which it coats the blanket cylinder of the final downstream station to convert said station to a coating station for the application of either spot or continuous coatings to the surface of the image-printed copies.

The novel apparatus of the present invention comprises a coating application apparatus for an offset printing machine and a printing machine containing such an apparatus, the coating application apparatus having a movable carriage designed for operative association in one position with the plate cylinder and in another position with the blanket cylinder of the final liquid application station of the offset printing machine, the coating carriage being adjustably supported for automatic movement between said two different coating positions. One coating position brings the coating application roll of the carriage into coating association with the plate cylinder for the offset formation of predetermined printed spot coatings onto predetermined image-printed areas of the copy sheets. The other coating position brings the coating application roll of the carriage into coating association with the blanket cylinder for the offset formation of a continuous coating onto the entire image-printed surface of the copy sheets. This enables the printing machine to image-print and coat-print the copy web or sheets in a continuous in-line operation, the apparatus being adjustable in simple fashion with a minimum make-ready time to adapt the coat-print step to the application of either spot coatings or continuous coatings depending upon the requirements of the printing operation. This increases the versatility of the offset printing machine, avoids the need for separate printing machines or for separate runs of the printed stock and enables the in-line precise printing of spot coatings in tight register and adjustable thickness, which was not possible with any prior-known offset printing machine.

The novel apparatus of the present invention enables the final downstream liquid application station of the printing machine to be used as either an ink-printing station or as a coating-application station and permits simple and rapid conversion between such utilities.

DETAILED DESCRIPTION OF THE INVENTION

Figure 1:
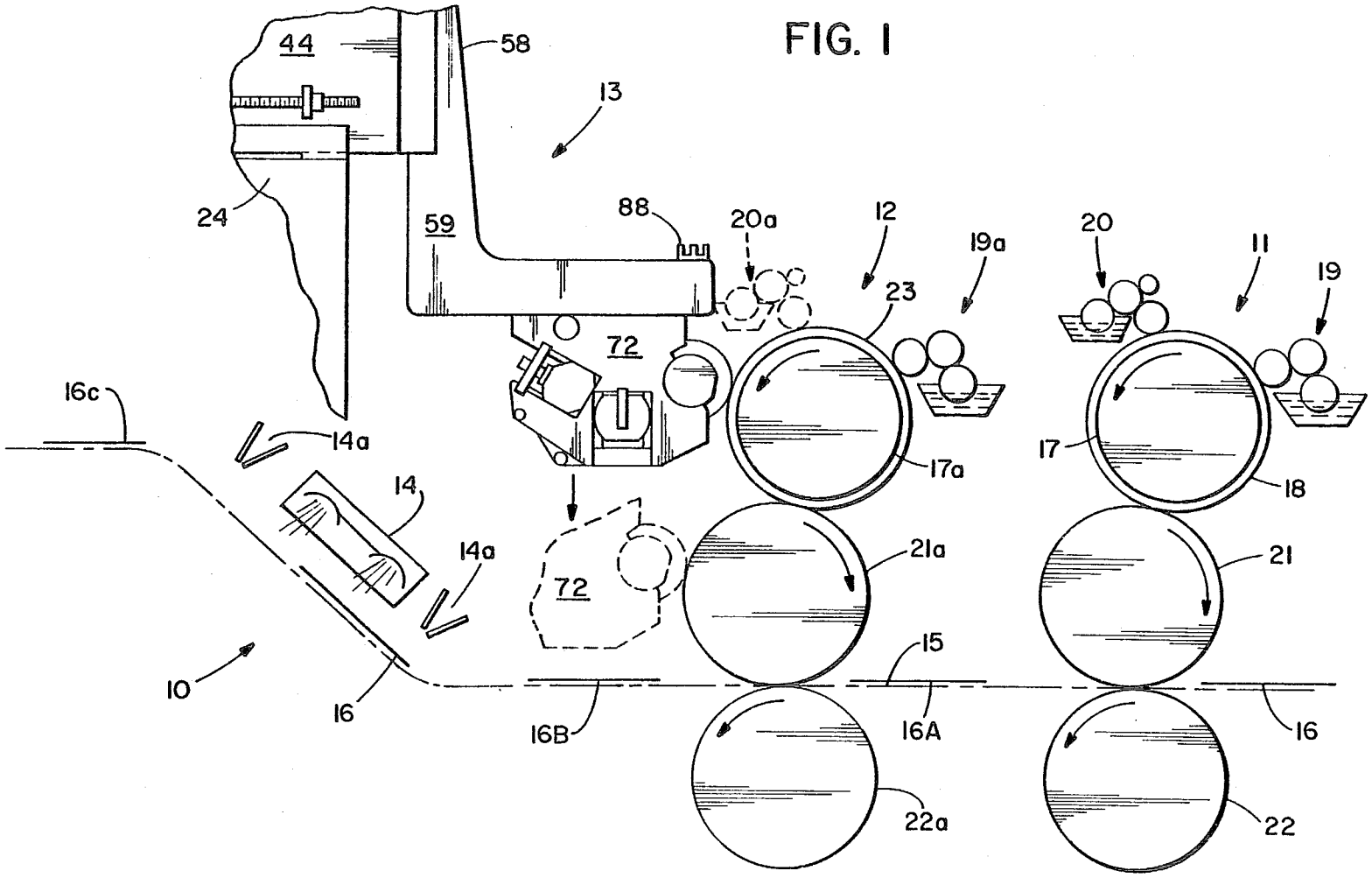
FIG. 1 is a vertical cross-sectional view through two downstream liquid application stations of an offset printing machine, illustrating a coating-application unit according to one embodiment of the present invention.

Referring to the drawings, FIG. 1 illustrates a downstream portion of an offset printing machine 10 comprising two liquid application stations 11 and 12, the latter including a coating apparatus 13 comprising a coating carriage 58, a radiation drying station 14 including air knives 14*a*, and a continuous copy sheet gripper system 15 which moves a succession of copy sheets 16 through the printing machine.

The first liquid application station 11 is a conventional offset image printing station comprising a plate cylinder 17, to which is clamped an imaged lithographic printing plate 18 carrying oleophilic image areas, such as words, photographs, etc. on an oleophilic background. The conventional clamping means permits some degree of lateral or axial adjustment and some degree of wrap-around or circumferential adjustment of the plate 18 relative to the plate cylinder 17. Plate cylinder 17 is associated with a dampening system 19 for wetting the entire background surface of plate 18 with aqueous dampening fluid, and with an inking system 20 for inking the imaged areas of the plate 18 with liquid oleoresinous ink.

The inked plate 18 is rotated against the ink receptive surface of a blanket cylinder 21, to which the wet ink images are offset or transferred, and the blanket cylinder 21 is rotated against a copy sheet 16, passed in the nip between the blanket cylinder 21 and an impression cylinder 22, to transfer the wet ink images to the copy sheet 16 and form an image-printed copy sheet 16A which is conveyed to the last liquid application station 12 which includes the coatingapplication apparatus of the present apparatus.

The coating application station 12 can be similar to the inking station 11 with respect to the plate cylinder 17*a* supporting a printing plate dampening system 19*a*, blanket cylinder 21*a* and impression cylinder 22*a* since in a conventional offset printing machine having a plurality of liquid application stations, all of the stations are generally similar but use different printing plates to image different areas of the same copy sheet with different colored inks. The present apparatus modifies the final downstream inking station to convert it permanently or intermittently to a versatile coating station.

Plate 23 is an offset relief printing plate, preselected areas of which are raised above the background, generally referred to as "relief spots". Such spots are sized and positioned to correspond to areas of the image-printed copy sheets 16*a* which it is desired to selectively coat.

The essential novelty of the apparatus of FIG. 1 resides in the adjustable coating apparatus 13 which is mounted onto the frame 24 of the printing machine for extension of the coating carriage 58 into the liquid application station 12 for adjustable coating association with either the coating plate cylinder 17*a* or the coating blanket cylinder 21*a*, as desired.

Figure 2A:
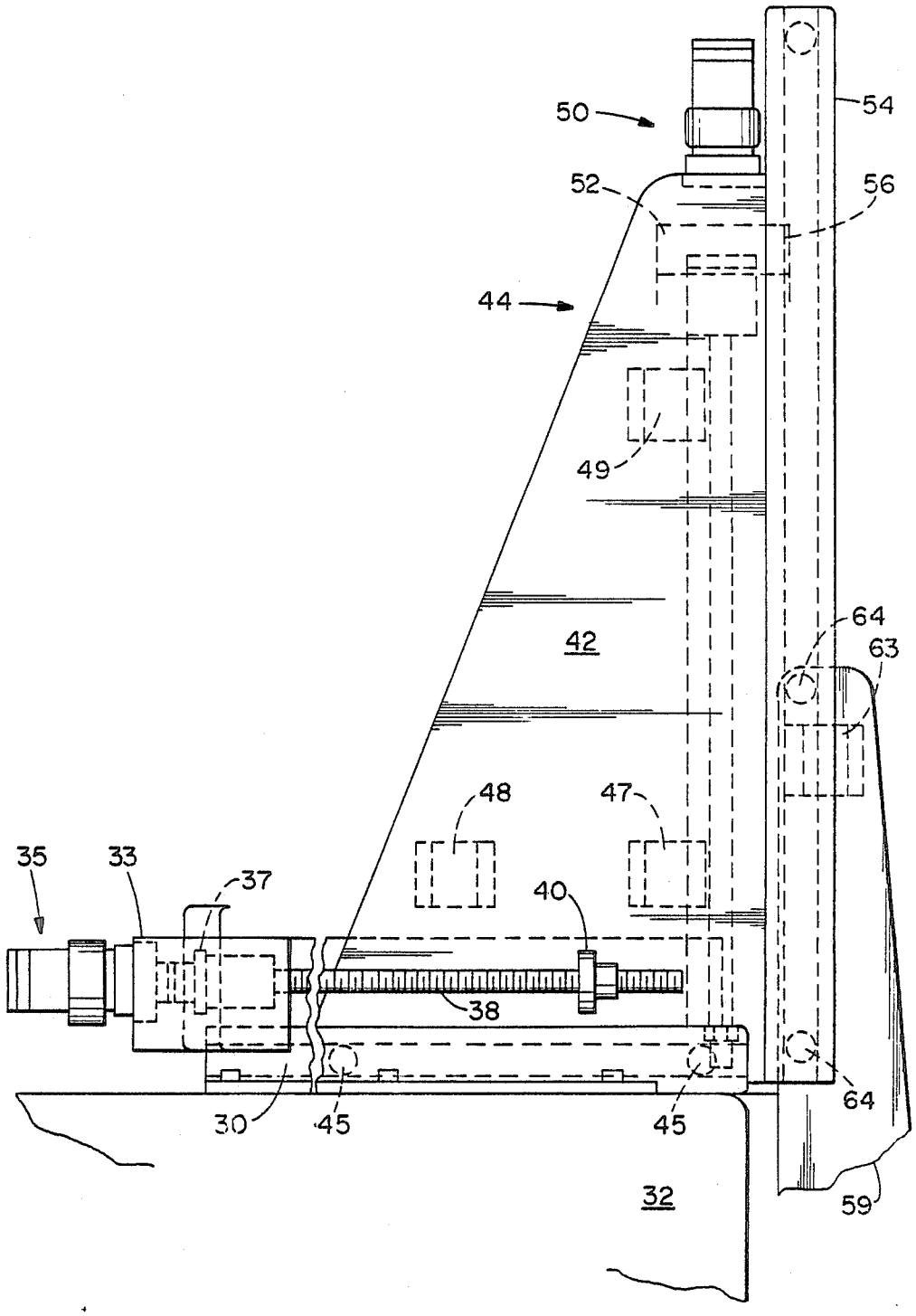
FIGS. 2A and 2B are segmented, detailed side views of coating application unit of FIG. 1
Figure 2B:
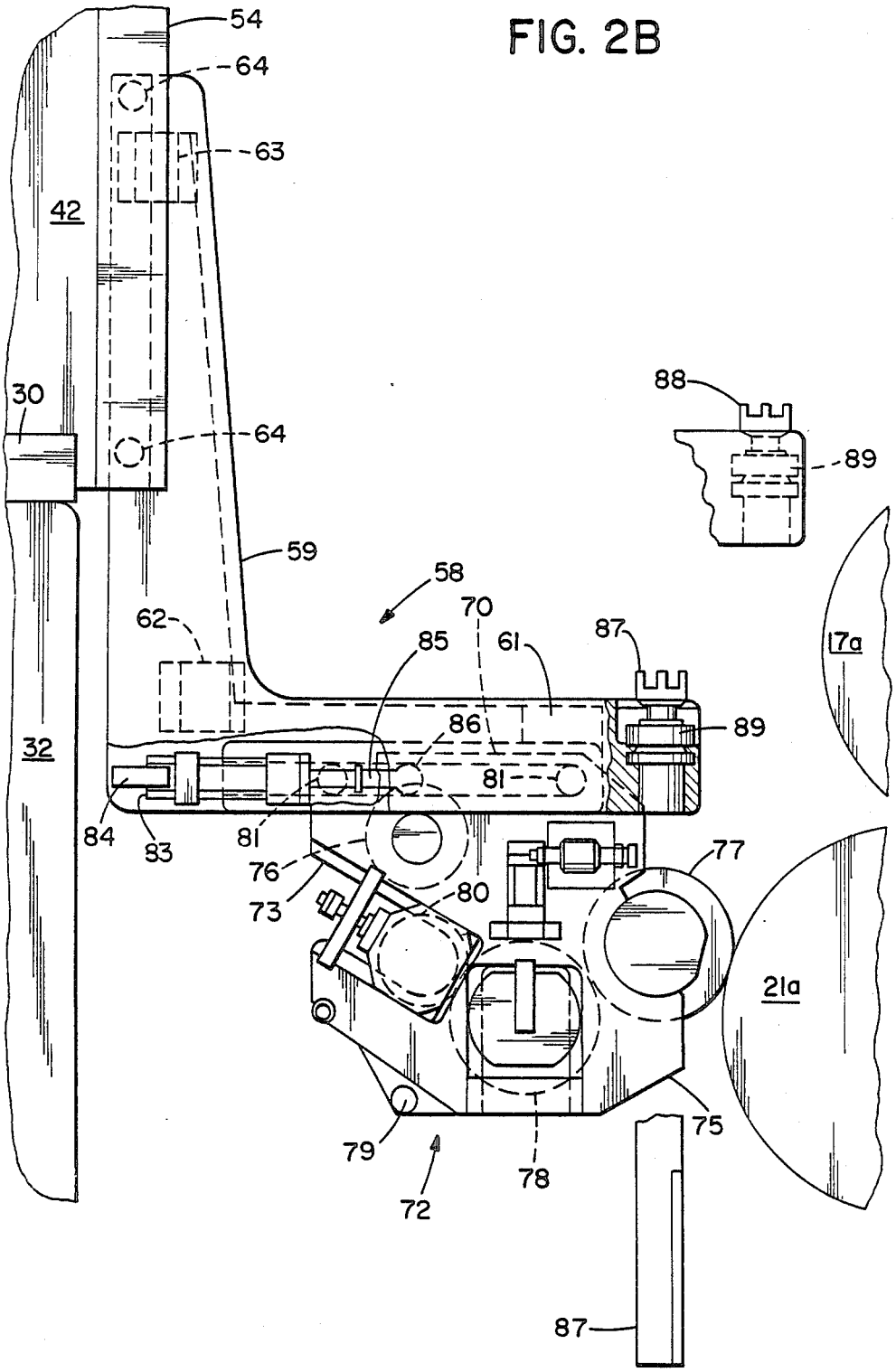
Figure 3:
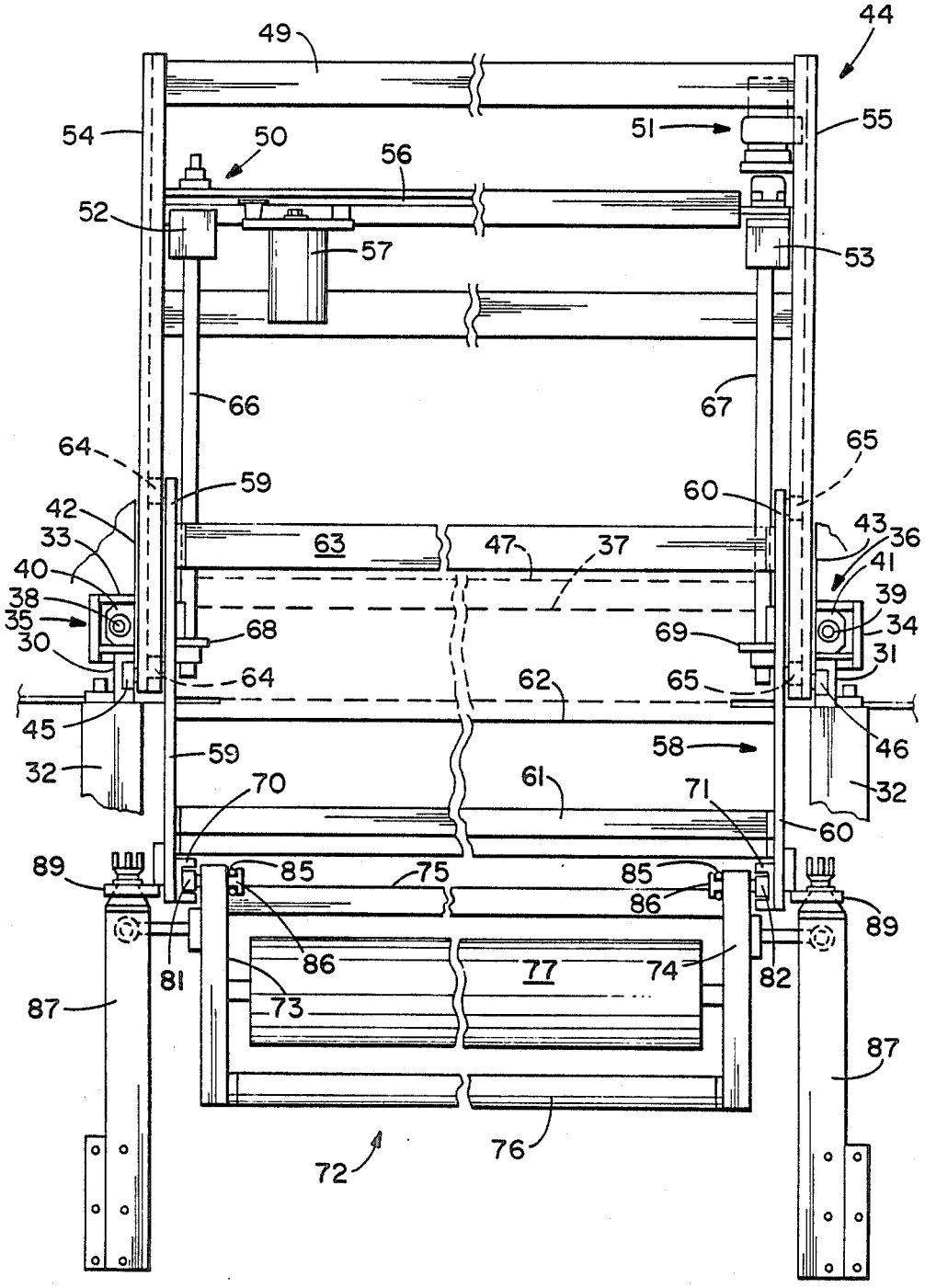
FIG. 3 is a horizontal front view of the coating application unit of FIG. 2.

The coating application apparatus 13, shown in greater detail in FIGS. 2 and 3, comprises a preferred embodiment of the present invention in that it includes a coating carriage 58 which is horizontally adjustably, in the machine direction, for movement between retracted or passive position and extended or active position, and also vertically adjustable for movement between the levels of the plate cylinder and the blanket cylinder. Moreover, the coating carriage 58 comprises a horizontally adjustable coating applicator unit 72 which is movable in the machine direction between different extended coating positions to accommodate plate and blanket cylinders which are not in vertical alignment, as shown by FIGS. 1 and 2B.

The coating application apparatus 13 of FIGS. 2A and 3 comprises a spaced pair of parallel, horizontal support rails 30 and 31 or legs designed to be bolted to frame portions 32 of the printing machine beyond station 12, rails 30 and 31 each being fastened to a gear housing 33, 34 of a hydraulic horizontal screw drive member 35, 36 connected to each other for simultaneous operation by a drive chain 37. The screw drive members 35 and 36 comprise reversible drive screws 38, 39 which threadably engage nuts 40, 41 which are fixed to the spaced vertical walls 42, 43 of the vertical lift housing 44.

Housing 44 is provided adjacent the bases of walls 42 and 43 with outward projecting cam follower or wheel pairs 45, 46 which are engaged within the horizontal tracks of the rails 30 and 31 to support the vertical lift housing 44 for horizontal movement between extended or active position, illustrated by FIGS. 1 and 2B, and retracted or passive position under the effects of hydraulic activation of the screw drive members 35 and 36. Walls 42 and 43 of housing 44 are fastened together and reinforced by cross-beams 47, 48 and 49.

Vertical or height adjustment of the coating application carriage 58 is made possible by a second pair of associated vertical screw drive members 50 and 51, shown most clearly in FIG. 3, each having a gear housing 52, 53 attached to the upper end of a vertical rail member, 54, 55 of the housing 44, and being connected to each other for simultaneous reversible operation by means of a drive chain 56 through a hydraulic motor 57.

Vertical lift housing 44 supports the vertically adjustable carriage 58 which comprises a spaced pair of L-shaped side wall members 59 and 60 fastened together by cross-beams 61, 62 and 63. The vertical extensions of wall members 59 and 60 are provided with cam follower or wheel pairs 64, 65 which ride within the vertical tracks of rail members 54 and 55 on the inside of housing walls 42, 43 to raise and lower the vertical carriage section 58 under the activation of the screw drive members 50 and 51 since the drive screws 66 and 67 thereof threadably engage nuts 68 and 69, respectively, which are fastened to the lower ends of the vertical extensions of the L-shaped wall members 59 and 60.

The horizontal extensions of the L-shaped wall members 59 and 60 of the carriage 58 comprise lower horizontal track members 70 and 71 which support the coating application unit 72 of the carriage for horizontal adjustment therewithin.

Coating application unit 72 of carriage 58 comprises spaced, parallel side frames 73 and 74 fastened together by cross members 75 and 76 and supporting coating applicator roll 77, pick-up roll 78 positioned to pick up liquid coating composition from the coating pan 79, and adjustable metering roll 80 positioned to control the amount of coating composition passed by the pick-up roll 78 to the applicator roll 77. The outer surfaces of the side frames 73 and 74 are provided adjacent the top edge of each with a spaced pair of cam followers or wheels 81, 82 which ride within the horizontal tracks of the track members 70, 71 of the L-shaped wall members 59 and 60, to support the coating applicator unit 72 for adjustable horizontal movement within the carriage 58.

As shown by FIG. 2, movement of the coating unit 72 is controlled by a pair of hydraulic cylinders 83 each attached by a bracket 84 to an L-shapedwall member 59, 60 in horizontal alignment with the track members 70 and 71, and having their rod end 85 attached to the inside wall of side frames 73, 74 at posts 86. Activation of the hydraulic cylinders causes the coating unit 72 to move horizontally along track members 70 and 71 to position the leading edge of the applicator roll 77 for coating association with either the coating blanket cylinder 21*a*, as shown in FIG. 2B, or the coating plate cylinder 17*a*, as shown in FIG. 1. Preferrably the printing machine frame is provided with spaced pairs of latch posts 87 and 88 or support brackets associated with the location of the blanket cylinder 21*a* and the plate cylinder 17*a* for engagement within latch brackets 89 attached to the outer surfaces of the horizontal extensions of the L-shaped wall members 59 and 60 in the area of the forward end of the track members 70 and 71. The engagement of the fixed latch post pair 87 within the latch brackets 89 secures the coating applicator carriage 72 in one position for coating the blanket cylinder 21*a*, as shown in FIGS. 2B and 3, while the engagement of the fixed latch post pair 88, shown by broken lines in FIG. 2B, within the same latch brackets 89 secures the coating applicator carriage 72 in another position, shown in FIG. 1, for coating the plate cylinder 17*a*. Such engagement requires a presetting of the sequence and duration of operation of the various hydraulic mechanisms. Engagement and disengagement of the latch brackets 89 on posts 87 and 88 requires vertical movement of the carriage 58 within the vertical lift housing 44 by predetermined directional and timed activation of the vertical screw drive members 50 and 51. Vertical alignment of the latch brackets 89 with the latch post pairs 87 and 88 must first be accomplished. This requires horizontal movement of the vertical lift housing 44 supporting the carriage 58 including the coating applicator unit 72, and is accomplished by predetermined directional and timed activation of the horizontal screw drive members 35 and 36, for movement of the vertical lift housing 44 from retracted, non-coating position to extended, aligned position. Movement of the coating applicator unit 72 into coating position requires predetermined directional and timed activation of the horizontal hydraulic cylinders 83. Adjustable stop members may be incorporated to limit the various movements.

As will be clear to those skilled in the offset printing art, the novel printing and coating apparatus of the present invention enables the modification of a conventional offset printing machine having a plurality of liquid application stations to convert it to a printing and coating apparatus which is adjustable in simple manner for the alternative application of either full coatings or spot coatings. Moreover, such modification may be temporary, if desired, so that the final downstream liquid application station may be used for its intended purpose for the application of printed ink images or for its modified purpose for printing overall or spot coatings. The conversion from printing use to spot coating use merely requires retracting or disengaging the ink applicator roll of unit 20*a* to position shown by broken lines in FIG. 1, replacing the image printing plate on plate cylinder 17*a* with a relief coating plate 23, cleaning the surface of the blanket cylinder 21*a* and moving the coating application unit 13 horizontally from retracted position to extended position. If overall or complete coatings are desired it is only necessary to retract or disengage the plate cylinder 17*a* from coating association with the blanket cylinder 21*a*, without any alteration of the plate cylinder 17*a* or its printing plate 23 or ink application unit 20*a*.

The present coating applicator roll 77 has a substantially smaller diameter than that of the plate cylinder 17*a* or the blanket cylinder 21*a*, the diameters of which are equal. The speed of rotation of the applicator roll 77 is adjustable so that its surface speed may be the same as or slower or faster than the surface speed of cylinders 17*a* and 21*a*, or in reverse rotation thereto, to provide a brushing action relative thereto, if desired. Such brushing action provides a shearing of the coating composition in the nip therebetween, and a relatively heavy or thick direct deposit of coating composition on cylinders 17*a* and 21*a* in cases where the surface speed of roll 77 is faster than that of roll 17*a* or 21*a*. This is desirable particularly for the application of spot coatings, since the coating thickness is always split to about one-half as the spot coating is transferred from the relief plate 23 of plate cylinder 17*a* to the blanket cylinder 21*a*, and further, split to about one quarter when the spot coating is transferred from the blanket cylinder 21*a* to the printed copy sheets 16A. The effect of such inherent splitting is reduced by increasing the coating thickness on the relief areas of plate 23.

In cases where the coating composition is applied directly to the blanket cylinder 21*a*, for the application of continuous coatings to the printed copy sheets 16A, the plate cylinder 17*a* is retracted from contact with the blanket cylinder 21*a* so that the only coating split occurs during transfer from the blanket cylinder 21*a* to the imaged copy sheets 16A.

The offset printing machines to which the present invention applies are conventional machines and therefore the present disclosure does not include details regarding the support structure for the various rolls, dampening units, inking units, sheet conveyor system, drying station, or copy sheet supplying and stacking stations. In most modern printing machines, the sheet conveyor system is not a gripper belt or chain but rather comprises automatic grippers on a series of contacting impression cylinders and transfer cylinders.

Also, the present coating compositions and systems for providing continuous supplies thereof to the coating applicator unit are conventional in the art.

The terms "vertically" and "horizontally" are used herein and in the appended claims to define general directions of movement, including angular vertical movement from one level to another and/or angular movement in the machine direction. For example, on printing machines where the coating plate cylinder is not in perfect vertical alignment above the blanket cylinder it may be preferable that the vertical rail or track of the vertical lift housing is inclined at an angle similar to the angle from vertical formed by a straight line contacting the surfaces of the plate cylinder and the blanket cylinder to be contacted by the coating applicator roll. Movement of the coating carriage along such an inclined vertical rail is both generally vertical and generally horizontal. Similarly the horizontal track members for the support legs of the apparatus and/or for the coating applicator unit may also be angular to provide some degree of vertical movement in cases where the design of the printing machine frame supporting the present apparatus makes it necessary or advantageous.

It is to be understood that the above described embodiments of the invention are illustrative only and that modifications throughout may occur to those skilled in the art. Accordingly, this invention is not to be regarded as limited to the embodiments disclosed herein, but is to be limited as defined by the appended claims.

What is claimed is:

1. An adjustable in-line coating application apparatus for attachment in association with a dowmnstream liquid application station of an offset printing machine having a plurality of liquid application stations, for converting said downstream liquid application station to a coating application station for applying either continuous or spot coatings over the printed surface of a succession of copy sheets carrying ink images printed thereon at one or more upstream liquid application stations, said downstream liquid application station containing a blanket cylinder positioned to contact said plurality of printed copy sheets and an offset plate cylinder in vertical elevation above said blanket cylinder and supported for adjustment into and out of coating association therewith, said coating application apparatus having vertical guide means, a coating carriage attached to said support for substantially vertical movement along said guide means, said carriage comprising a coating application unit, including a container for a supply of liquid coating composition and an elongate coating applicator roll supported to receive a uniform supply of said composition on the surface thereof and to transfer a uniform supply of said composition to the surface of either a plate cylinder or a blanket cylinder in coating association therewith, and mechanical adjustment means for moving said carriage on said guide means relative to said support vertically between elevations corresponding to the locations of the blanket cylinder and the plate cylinder of an offset printing machine in order to move said coating applicator roll into coating association with either said blanket cylinder or said plate cylinder, as desired.

2. An apparatus according to claim 1 in which the support for said coating application apparatus comprises a spaced pair of parallel elongate horizontal leg members designed to be fastened relative to the frame of an offset printing machine.

3. An apparatus according to claim 2 in which said support comprises a parallel pair of spaced vertical wall members which are fastened to each other to form a vertical guide means on a vertical lift housing for said coating carriage.

4. An apparatus according to claim 3 in which said horizontal leg members comprise horizontal tracks, and said vertical wall members are movably attached to said horizontal tracks to permit horizontal adjustment of the position of said vertical lift housing.

5. An apparatus according to claim 4 in which said coating carriage comprises a parallel pair of vertical side members which are fastened to each other to form said carriage, each said side member being supportingly-engaged by a vertical guide means on a wall member of the vertical lift housing for vertical movement of said carriage relative to said housing.

6. An apparatus according to claim 5 in which each of the vertical side members of the carriage includes a lower, horizontal support extension to which the coating application unit is attached.

7. An apparatus according to claim 6 in which the horizontal support extensions comprise horizontal tracks to which the coating applicator unit is attached to permit horizontal adjustment of the coating applicator unit on the carriage relative to the vertical lift housing.

8. An apparatus according to claim 1 in which said coating carriage comprises releasable latching means for securing the unit relative to the frame of an offset printing machine when the carriage is positioned for movement of the applicator unit into coating association with either the blanket cylinder or the plate cylinder.

9. An apparatus according to claim 5 comprising automatic mechanical means for moving said carriage vertically relative to said vertical lift housing, said means comprising a vertical screw drive assembly one end of which is fastened to a vertical side wall of said housing and the other end of which is fastened to an adjacent vertical side member of said carriage.

10. An apparatus according to claim 4 in which said horizontal adjustment of the position of the vertical lift housing is provided by at least one horizontal screw drive assembly one end of which is fastened to a horizontal leg member and the other end of which is fastened to an adjacent wall member of the vertical lift housing.

11. An assembly according to claim 7 which further comprises means for causing horizontal movement of the coating applicator unit relative to the coating carriage, said means comprising at least one horizontal drive member one end of which is fastened to the applicator unit and the other end of which is fastened to the horizontal support extension of the carriage.

12. An offset printing machine having a frame supporting a plurality of in-line liquid application stations, each station comprising a blanket cylinder positioned to contact a succession of copy sheets to apply liquid thereto, and an offset plate cylinder in printing association with said blanket cylinder to apply liquid to predetermined areas thereof for transfer to said blanket cylinder and retransfer to said copy sheets, the final downstream liquid application station comprising a liquid coating station for the application of continuous or spot coatings over areas of the copy sheets which are image-printed with ink in at least one upstream liquid application station which is an ink printing station, said liquid coating station having said plate cylinder and said blanket cylinder in vertical elevation relative to each other and comprising a coating application carriage including a coating applicator unit having a container for liquid coating composition and a coating applicator roll which receives a continuous supply of said liquid coating composition from said container, and vertical guide means for supporting said coating application carriage for mechanically-adjustable vertical movement along said guide means between a first coating elevation position in which said coating applicator roll is in coating association with said blanket cylinder and a second coating elevation position in which said coating applicator roll is in coating association with said plate cylinder, whereby said carriage can be moved mechanically to said first position to cause the application of a continuous liquid coating to the image printed surface of the copy sheets, and can be moved mechanically to said second position to cause the application of spot liquid coatings to predetermined limited areas of the image printed surface of the copy sheets.

13. A machine according to claim 12 in which said carriage is movable out of coating association with said blanket and/or plate cylinders and said final downstream liquid application station is adapted for alternative use as another ink printing station.

14. A machine according to claim 12 in which the means for supporting said coating application carriage includes a spaced pair of horizontal leg members designed to support the coating application carriage in association with final downstream liquid application station.

15. A machine according to claim 12 in which the means for supporting said coating application carriage includes a parallel pair of vertical wall members which are fastened to each other and to said guide means to form a vertical lift housing for said carriage.

16. A machine according to claim 15 in which said vertical wall members are movably attached to horizontal track members to permit horizontal adjustment of the position of said vertical lift housing relative to the blanket and plate cylinders.

17. A machine according to claim 16 in which said coating carriage comprises a parallel pair of vertical side members which are fastened to each other to form said carriage each said side member being supportingly engaged by a vertical guide means on a wall member of the vertical lift housing for vertical movement of said carriage relative to said housing and between at least said first and second coating positions.

18. A machine according to claim 17 in which each of said vertical side members of the carriage includes a lower horizontal support extension to which the coating applicator unit is attached.

19. A machine according to claim 18 in which said horizontal support extensions comprise horizontal tracks to which the coating applicator unit is attached to permit horizontal adjustment of the coating applicator unit relative to the coating carriage and the blanket and plate cylinders.

20. A machine according to claim 12 in which the frame of said machine includes first position latching means associated with the blanket cylinder, and second position latching means associated with the plate cylinder in said coating application station, and said coating carriage includes mating latching means which engage said position latching means when the carriage is moved into said first coating position and into said second coating position.

21. A machine according to claim 17 comprising automatic mechanical means for moving said carriage vertically relative to said vertical lift housing, said means comprising at least one vertical screw drive assembly one end of which is fastened to a vertical side wall of said housing and the other end of which is fastened to an adjacent vertical side member of said carriage.

22. A machine according to claim 16 which comprises automatic means for providing horizontal adjustment of the position of the vertical lift housing comprising at least one horizontal screw drive assembly one end of which is fastened to a horizontal track member and the other end of which is fastened to an adjacent wall member of the vertical lift housing.

23. A machine according to claim 19 which further comprises means for causing horizontal adjustment of the coating applicator unit relative to the coating carriage, said means comprising at least one horizontal drive member one end of which is fastened to the applicator unit and the other end of which is fastened to the horizontal support extension of the coating carriage.

* * * * *